United States Patent [19]

Brooks et al.

[11] Patent Number: 4,543,736

[45] Date of Patent: Oct. 1, 1985

[54] CONDITIONING APPARATUS

[76] Inventors: Derrick W. Brooks, 18 Ridge La., Radcliffe on Trent, Nottingham; Christopher P. Morris, 303 Oakdale Rd., Carlton, Nottingham, both of England

[21] Appl. No.: 498,790

[22] Filed: May 27, 1983

[51] Int. Cl.[4] ..... F26B 21/06

[52] U.S. Cl. ..... 34/46; 34/47; 34/54; 34/57 A; 34/164

[58] Field of Search ..... 34/46, 47, 54, 57 A, 34/164; 131/296, 304

[56] References Cited

U.S. PATENT DOCUMENTS

| | | | |
|---|---|---|---|
| 1,431,145 | 10/1922 | Bolling | 34/47 |
| 2,245,881 | 6/1941 | Vissac | 34/164 |
| 3,022,988 | 2/1962 | Corson et al. | 34/164 |
| 4,241,515 | 12/1980 | Wochnowski et al. | 34/46 |
| 4,434,563 | 3/1984 | Graalman et al. | 34/46 |

FOREIGN PATENT DOCUMENTS

| | | |
|---|---|---|
| 2724037 | 12/1978 | Fed. Rep. of Germany . |
| 2190693 | 2/1974 | France . |
| 2261050 | 2/1975 | France . |
| 868675 | 5/1961 | United Kingdom . |
| 1407427 | 9/1975 | United Kingdom . |
| 1476364 | 6/1977 | United Kingdom . |
| 1591819 | 6/1981 | United Kingdom . |

*Primary Examiner*—Larry I. Schwartz
*Assistant Examiner*—David W. Westphal
*Attorney, Agent, or Firm*—Edmund F. Bard & Assoc.

[57] ABSTRACT

Conditioning apparatus for conditioning a leaf vegetable material of a fibrous nature, which apparatus comprises a perforate bed whereby gaseous conditioning medium may be supplied through the perforations to establish a conditioning zone immediately above the bed whereby, in use, the material can be maintained in effectively a fluidized state, the bed being supported in a frame in a manner which permits adjustment of the configuration of the bed relative to the frame at least in a direction of feed of the material to be conditioned. The bed is supported above a plenum chamber arranged to be supplied with conditioning medium being supplied from means comprising an inlet duct for conditioning medium under pressure, said inlet duct communicating with a first and second duct each communicating with said plenum chamber, heating means provided in said first duct, and bleed-off means associated with at least one of said first and second ducts whereby the relative proportions of heated and unheated conditioning medium entering the plenum chamber can be adjusted.

10 Claims, 5 Drawing Figures

CONDITIONING APPARATUS

This invention relates to conditioning apparatus and more particularly concerns apparatus for conditioning material such as leaf vegetable material of a fibrous nature. Conditioning generally relates to adjusting the temperature and/or moisture content of the material, e.g. by drying, moisturising, heating and/or cooling the material.

Prior British Patent Specification No. 1486555 describes an apparatus for drying tea in which the tea to be dried is maintained in a fluidised state in a bed above a perforated plate. Drying air is blown through the perforations in the plate at a rate which maintains the tea in the desired state of fluidisation. The tea may be fed along the plate to a further conditioning stage or a discharge conveyor by applying an appropriate vibration to the plate and control of the rate of flow may be affected by disposing one or more weirs at the ends of the plate.

U.K. Pat. No. 2026668A describes a conditioning apparatus for conditioning leaf material such as tea or tobacco utilising a particular type of gas distribution means for maintaining the leaf material to be conditioned in a fluidised state. The flow of conditioned material to a next conditioning stage or to a discharge conveyor is controlled by means of weirs.

In the conditioning of tobacco it is desirable to produce a consistent moisture content (for example 14 to 21% by weight) from a feed having a widely varying moisture content. The feed may be leaf tobacco or may be derived from other sources such as stem (e.g. cut rolled stem).

It is an object of the present invention to provide an improved conditioning apparatus for vegetable leaf material of a fibrous nature, especially tobacco.

According to one aspect of the present invention we provide conditioning apparatus for conditioning a leaf vegetable material of a fibrous nature, which apparatus comprises a perforate bed whereby gaseous conditioning medium may be supplied through the perforations to establish a conditioning zone immediately above the bed whereby, in use, the material can be maintained effectively in a fluidised state, the bed being supported above a plenum chamber arranged to be supplied with conditioning medium, the conditioning medium being supplied from means comprising an inlet duct for conditioning medium under pressure, said inlet duct communicating with a first and a second duct each communicating with said plenum chamber, heating means provided in said first duct, and bleed-off means associated with at least one of said first and second ducts whereby the relative proportions of heated and unheated conditioning medium entering the plenum chamber can be adjusted.

Preferably, the bleed-off means is controlled automatically to respond to a measurement of a condition of the material being conditioned or gaseous conditioning medium.

In one embodiment according to this aspect of the invention a balancing throttle is associated with one of said ducts, preferably the inlet duct, in order to control the pressure in the plenum chamber. The inlet duct is provided with a take-off duct and said bleed-off means includes a duct, the take-off duct and bleed-off duct being controlled by a common adjustable baffle and communicating with a duct incorporating said balancing throttle.

According to a further aspect of the present invention, a conditioning apparatus for conditioning a leaf vegetable material of a fibrous nature, which apparatus comprises a perforate bed whereby gaseous conditioning medium may be supplied through the perforations to establish a conditioning zone immediately above the bed whereby, in use, the material can be maintained in effectively fluidised state, the bed being supported in a frame in a manner which permits adjustment of the configuration of the bed relative to the frame at least in a direction of feed ofo the material to be conditioned.

Conveniently, adjustable supporting means are provided at or adjacent each corner of a rectangular bed whereby adjustment may be effected in both the direction of feed of material and a direction transverse thereto.

By this means the dwell time of the material in the conditioning zone can be controlled by adjusting the angle of the bed to achieve the desired rate of flow. Furthermore with preferred arrangement described above transverse adjustment can be effected to ensure that an even flow across the width of the bed is achieved.

The bed may be arranged to vibrate and in this case the dwell time of the material in the conditioning zone may also be determined by the vibration frequency; to this end it is preferred to use a vibrating frequency of 300 to 1500 cycles per minute.

In one embodiment of the invention, each supporting means for the bed comprises a height adjustment means and is advantageously associated with resilient means the tension of which can also be adjusted. In this way, not only is it possible to adjust the angular disposition of the bed, but it is also possible to adjust the resilient means in order to obtain a uniform vibration.

The invention also includes a conditioning plant including one or more apparatus as described above.

Provision may be made in any or all of the apparatus comprising the plant to adjust the temperature or any other condition of the conditioning medium. One such other condition which may be adjusted is moisture content, e.g. by the injection of steam.

Reference is now made to the accoxpanying drawings in which.

Figure 1:
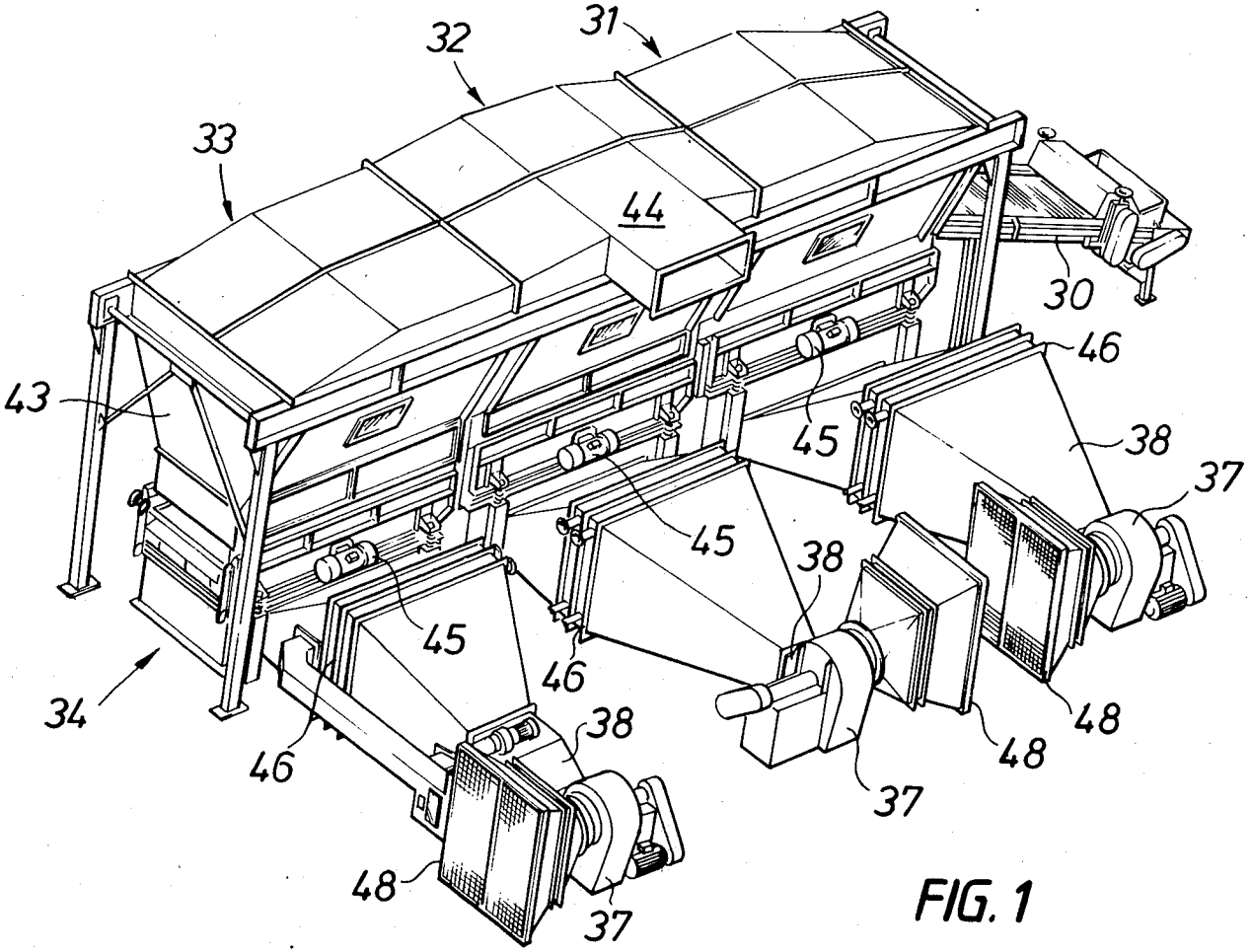
FIG. 1 is a perspective view of a conditioning apparatus according to the present invention.

Referring to FIG. 1, a conditioning plant comprises a feed conveyor 30 for leaf material to be conditioned, three conditioning apparatus 31, 32, and 33 and a discharge position 34 for leaf material which has been conditioned. Conditioning air is supplied to each apparatus by means of an individual filter 48 and a fan 37 which forces the air along ducts 38, incorporating heaters 46 towards plenum chambers 39 in each conditioning apparatus (see FIG. 2).

The heaters 46 are steam heated heat-exchange elements but if desired, heat exchange elements heated by other means may be employed for example, gas, oil, wood or electricity.

Each duct 38 may be provided with an inlet pipe with valve (not shown) which can be used to add additives to the air flowing into the plenum chamber 39. One additive which is frequently used in conditioning apparatus is live steam to increase the moisture content of the conditioning air.

Figure 2:
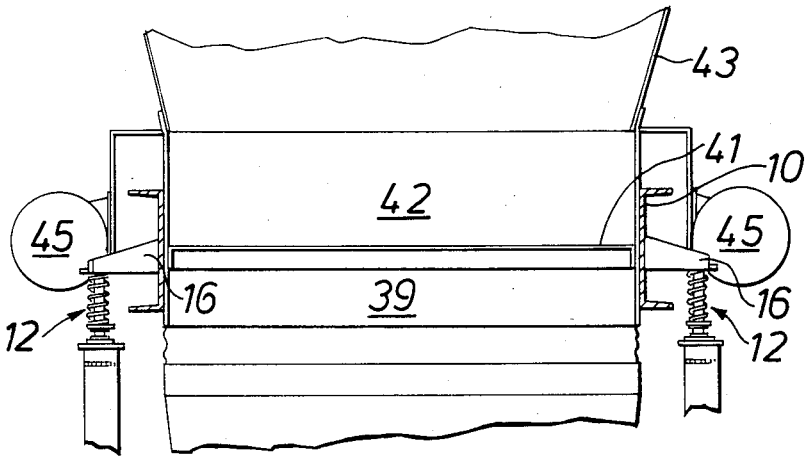
FIG. 2 is a schematic end elevation of part of a conditioning apparatus shown in FIG. 1.

The air passes through heaters 46 to each plenum chamber 39 and then through a perforate bed 41 into a fluidised conditioning zone 42 where it maintains the leaf material to be conditioned in a fluidised state (see FIG. 2). The air which emerges from the conditioning zone 42 is confined by each housing 43 and is extracted by means of a common air extractor hood and duct 44. If desired the housing 43 of one or more of the conditioning apparatus may include one or more adjustable baffles above the conditioning zone 42 in order to obtain a desired air flow pattern.

The perforate bed 41 comprises a rectangular perforate plate 11 disposed in a bed frame 10 supported by means of adjustable supporting means 12 arranged one at each corner of the frame 10.

Figure 3:
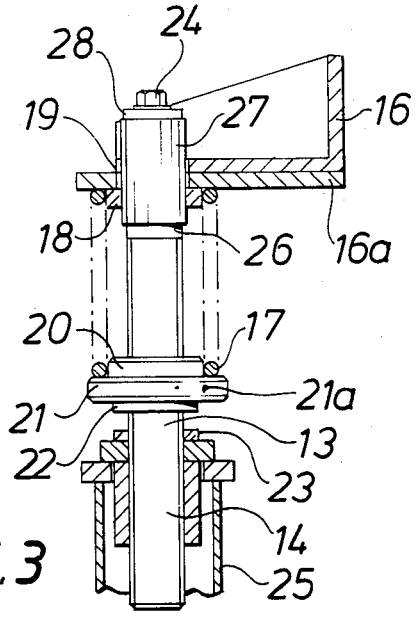
FIG. 3 is a detail showing in cross-section, one of the supporting means for the bed of the apparatus shown in FIGS. 1 and 2.

The construction of each supporting means 12 is shown in detail in FIG. 3. A threaded rod 13 is received in a threaded bore 14 in a main frame support member 25 and is retained in its adjusted position by a lock-nut 23.

The other end of the rod 13 carries a washer 26 a rubber bush 27 and a washer 28. A threaded axial bore at the upper end of the rod 13 receives a bolt 24 to hold the rubber bush 27 in position.

A plate **16*a* is welded to the bracket 16 and includes a bore 19 to receive the rubber bush 27, thereby providing a mounting for the bracket 16 which is secured to the bed frame 10. The use of the rubber bush 27 accommodates a small amount of lateral vibration of the perforate plate 41**.

A coil compression spring 17 is disposed coaxially with the tube 13 beneath the plate **16*a* and is located by a spigot 18 welded to the plate 16*a* at one end and at the other end by a spigot 20 on an adjusting ring 21. The adjusting ring 21 includes three radially equally distributed holes 21*a* into which a bar may be inserted to rotate the ring and thereby adjust the compression of the spring 17**.

In order to ensure that the ring 21 remains in its adjusted position, a lock nut 22 is provided.

Adjustment for height is effected by rotating the rod 13 with respect to the frame support member 25 to the desired extent and the rod 13 is then retained in its adjusted position by means of the lock nut 23.

One or more vibration motors may be used to effect vibration of the bed 41. In the embodiment shown in FIG. 2, two such vibration motors 45 are fixed to each bed, one on each side thereof.

It is preferred to arrange the vibrations to take place mainly in a vertical plane and these vibrations are, of course, permitted by the compression spring 17.

In the embodiment shown leaf material which is to be conditioned is fed by means of the feed conveyor 30 into the first conditioning apparatus 31 where it progresses along the bed by virtue of it being in a fluidised state and by virtue of angle and the vibration of the bed.

In this way the material progresses to the second apparatus 32 and the third apparatus 33 before being discharged.

It has been found that mounting the bed in an adjustable manner as described above has considerable advantages, particularly when conditioning fibrous leaf material such as tobacco.

The facility for height adjustment at each corner of the plate enables an even thickness of fluidised bed to be achieved laterally and also enables the plate to be angled longitudinally to provide a suitable flow (and hence dwell time) of the particular material being conditioned. Furthermore, the facility for adjustment of each spring enables equalisation of the vibration of the bed to be achieved. These adjustments give close control of the conditioning process. Furthermore the use of wiers is obviated, which is advantageous as they can cause problems when fibrous material such as tobacco is being conditioned.

The arrangement of the apparatus described above may be used to carry out a wide variety of conditioning processes. For example, when conditioning tobacco the provision for heating the conditioning air enables the apparatus to be used for drying, which may be carried out at temperatures up to 350° C., and the drying air may have a controlled humidity level by virtue of the provision for adding live steam.

The residence time may vary over a wide range from a few seconds up to about ten minutes depending the material and conditioning required.

It is envisaged that adjustment of the angular disposition of the bed could be made automatic. To achieve this, sensing means could be provided to measure a specific quality of the leaf material, such as moisture content, this measurement could be compared with a pre-determined desired measurement, the difference being used as a feed-back to the adjusting means which may then be adjusted, for example, by suitable servo motors.

In order to provide accurate control of the condition of the leaf material being conditioned at least one of the apparatus in the conditioning plant is provided with a conditioning medium temperature control system. Usually this will comprise the final apparatus in the plant.

Tobacco which is required to be conditioned has a wide variation in moisture content but it is desired that the conditioned tobacco has a predetermined moisture content, for example 14 to 21% by weight. The temperature of the conditioning air can be adjusted by adjusting the heat transferred by the heating means, e.g. by controlling the rate of feed or temperature of steam fed to heaters comprising steam heat exchangers. Such an arrangement can give a coarse adjustment of the temperature of the conditioning air fed to the associated plenum chamber.

When it is desired to control the moisture content precisely however such a coarse control is inadequate as it is impossible to make the required change in temperature in response to a measured deviation of the moisture content quickly enough to achieve the desired result.

Figure 4:
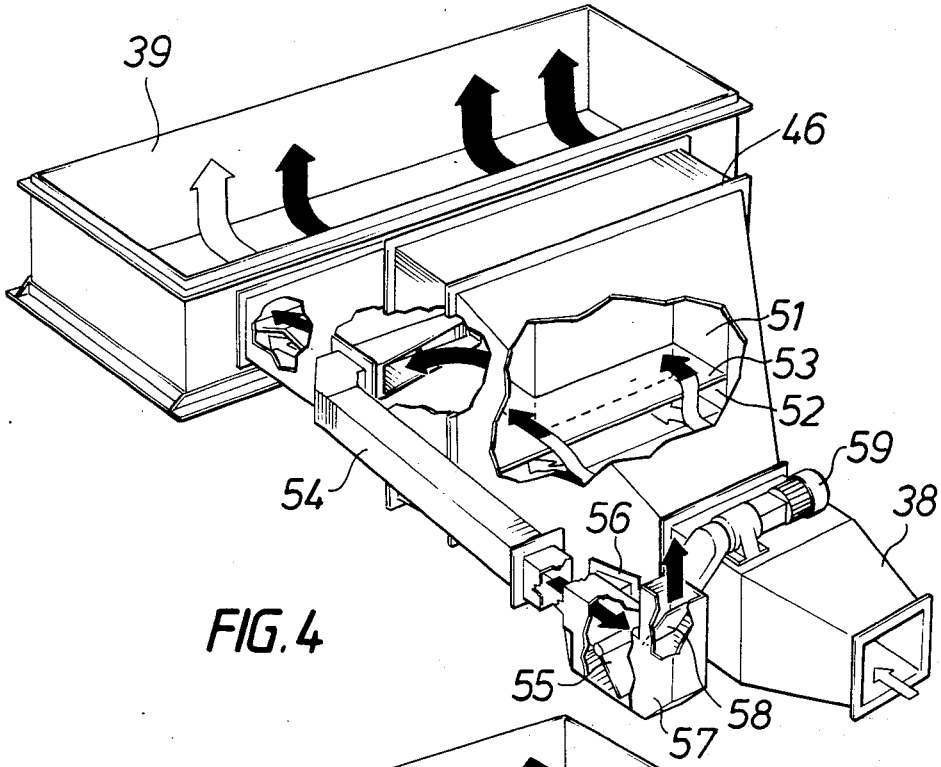
FIG. 4 is a perspective view.with part broken away of an air supply means incorporating a bleed-off and a balancing throttle shown with a bleed-off baffle in one position.
Figure 5:
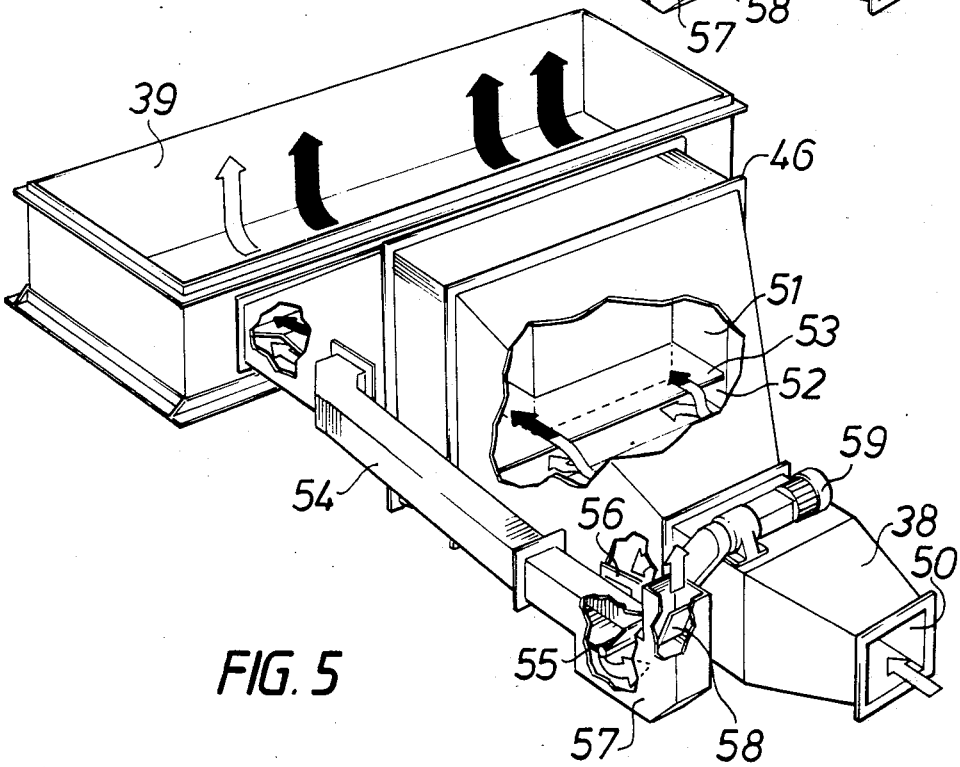
FIG. 5 is a view similar to FIG. 4 with the bleed-off baffle in another position.

In the embodiment shown in FIG. 1 the third apparatus is provided with a temperature control system and the detailed construction and operation of this system is illustrated in FIGS. 4 and 5.

The duct 38 comprises an inlet portion 50 which is divided into upper and lower ducts 51 and 52 by means of a baffle 53. The air passing through the upper duct 51 is heated by the heater 46 but the air passing through the lower duct 52 is not heated.

A bleed-off duct 54 communicates with the upper duct 51 and the bleed-off is controlled by a pivoted baffle 55. A take-off duct 56 is also controlled by the baffle 55 and communicates with the inlet portion 50 of the duct. The ducts 54 and 56 are combined downstream of the pivoted baffle 55 in a duct 57 controlled by a balancing throttle 58.

The balancing throttle 58 is adjusted to give sufficient resistance in the take-off duct to provide the desired pressure in the plenum chamber 39. Such a balancing throttle is employed in each apparatus in the plant but not in association with a bleed-off arrangement as in the third apparatus to provide temperature control.

The temperature control system operates as follows. A moisture-sensitive probe (not shown) is arranged to detect the moisture content of the tobacco about to be discharged. If there is a deviation from the desired moisture content this is utilised to provide an electrical feedback to motor 59 which controls the position of the pivoted baffle 55.

When the moisture content is low the baffle can be moved to the extreme position shown in FIG. 4. In this position heated air, illustrated by the black arrows, is bled off by way of the duct 54 to provide cooler air at the discharge end of the apparatus. Unheated air is illustated by white arrows.

When the moisture content is high the baffle can be moved to the extreme position shown in FIG. 5. In this position heated air is not bled-off but cold air from the inlet portion 50 of the duct is taken off. Thus a higher proportion of heated air is fed to the plenum chamber.

The control system described above provides a simple, effective and very quick-reacting temperature adjustment of conditioning air. The heat in any air which is bled-off can of course be utilised by returning air from the balancing throttle 58 to a previous apparatus.

The electrical feed back to control the position of the baffle can be instantaneous or, if desired, a controlled time delay can be introduced.

The motor controlled pivoted baffle 55 provides a quick-reacting fine adjustment but in order to accommodate wide variations in the moisture-content of the feed to the apparatus it is desirable to provide a coarse temperature control which will tend to try to maintain the baffle 55 at its mean position mid-way between that shown in FIG. 4 and in FIG. 5.

A suitable coarse control comprises a standard steam temperature probe arranged to measure the temperature of the bleed-off air. The temperature detected by this probe is utilised to control the flow of steam into the steam heated heat exchanger.

An alternative method to give a coarse control of the conditioning air is to control fan speed. In one example the fan speed can be controlled by limit switches which detect the position of the baffle.

Conditioning apparatus of the type described above has many advantages over conventional apparatus such as the rotary drier. These advantages include even air distribution, rapid response to a change in conditioning air, and a controlled flow of material along the bed. The improved apparatus according to the present invention enhances these advantages as a great degree of control is possible. Thus not only can the rate of flow across the bed be closely controlled but the bed can also be controlled in a direction transverse to the flow. The conditioning can be monitored at any stage e.g. by using moisture and/or temperature detectors both along and across the bed and the configuration of the bed and/or the nature of the conditioning air can be rapidly adjusted to achieve the desired result.

The apparatus and plant of the present invention thus provide a very desirable means of conditioning tobacco giving precise moisture content, enhanced product expansion and energy conservation due to efficient heat transfer. The conditioned product is also improved due to gentler handling and lower product degradation.

It has been found that the adjustment facility enables sufficient control for the apparatus to be used to separate certain components from a material being conditioned. For example, it is possible during conditioning of tobacco to classify the tobacco and separate relatively heavy and unacceptable products as they tend to 'sink' in the fluidised mass of material in the conditioning zone.

We claim:

1. Conditioning apparatus for conditioning a leaf vegetable material of fibrous nature, which apparatus comprises a perforate bed whereby gaseous conditioning medium may be supplied through the perforations to establish a conditioning zone immediately above the bed whereby, in use, the material can be maintained effectively in a fluidized state, the bed being supported above a plenum chamber arranged to be supplied with conditioning medium, the conditioning medium being supplied from means comprising an inlet duct for conditioning medium under pressure, said inlet duct communicating with a first and second duct each communicating with said plenum chamber, heating means provided in said first duct;

bleed-off means associated with at least one of said first and second ducts whereby the relative proportions of heated and unheated conditioning medium entering the plenum chamber can be adjusted;

the bed being supported in a frame in a manner which permits adjustment of the configuration of the bed relative to the frame at least in a direction of feed of the material to be conditioned, and in which the bleed-off means is controlled automatically to respond to a measurement of a condition of the material being conditioned.

2. Conditioning apparatus according to claim 1 in which a balancing throttle controls the pressure in the plenum chamber.

3. Conditioning apparatus according to claim 1 in which the bleed-off means comprises a duct having an adjustable baffle therein.

4. Conditioning apparatus according to claim 3 in which the adjustable baffle is arranged to control the flow of gaseous medium throught said duct and said bleed-off means.

5. Conditioning apparatus according to claim 1 in which a balancing throttle is associated with at least one of said ducts in order to control the pressure in the plenum chamber.

6. Conditioning apparatus according to claim 5 in which a take-off duct communicating with said inlet duct is connected to said balancing throttle and said bleed-off means also communicate with said balancing throttle.

7. Conditioning apparatus according to claim 1 wherein the measurement of a condition of the material being conditioned is also employed to control the heating means in said first duct.

8. Conditioning apparatus according to claim 1 in which adjustable supporting means are provided at or adjacent each corner of a rectangular bed whereby adjustment may be effected in both the direction of feed of material and a direction transverse thereto.

9. Conditioning apparatus according to claim 1 wherein the measurement of a condition of the gaseous conditioning medium is also employed to control the heating means in said first duct.

10. Conditioning apparatus for conditioning a leaf vegetable material of a fibrous nature, which apparatus comprises a perforate bed whereby gaseous conditioning medium may be supplied through the perforations to establish a conditioning zone immediately above the bed whereby, in use, the material can be maintained effectively in a fluidized state, the bed being supported above a plenum chamber arranged to be supplied with conditioning medium, the conditioning medium being supplied from means comprising an inlet duct for conditioning medium under pressure, said inlet duct communicating with a first and a second duct each communicating with said plenum chamber, heating means provided in said first duct;

bleed-off means associated with at least one of said first and second ducts whereby the relative proportions of heated and unheated conditioning medium entering the plenum chamber can be adjusted;

the bed being supported in a frame in a manner which permits adjustment of the configuration of the bed relative to the frame at least in a direction of feed of the material to be conditioned, and in which the bleed-off means is controlled automatically to respond to a measurement of a condition of the gaseous conditioning medium.

* * * * *